United States Patent [19]

Murasaki et al.

[11] Patent Number: 4,819,027

[45] Date of Patent: Apr. 4, 1989

[54] DEVELOPING APPARATUS

[75] Inventors: Hiroshi Murasaki, Ibaragi; Hiroshi Mizuno, Ikoma; Akihito Ikegawa, Sakai; Kouichi Etou, Takatsuki, all of Japan

[73] Assignee: Minolta Camera Kabushiki Kaisha, Osaka, Japan

[21] Appl. No.: 49,143

[22] Filed: May 13, 1987

[30] Foreign Application Priority Data

May 15, 1986 [JP] Japan ..... 61-111971

[51] Int. Cl.[4] ..... G03G 15/09; G03G 15/00

[52] U.S. Cl. ..... 355/3 DD; 118/657; 222/DIG. 1

[58] Field of Search ..... 355/3 DD; 118/652, 657, 118/658; 222/DIG. 1; 430/125

[56] References Cited

U.S. PATENT DOCUMENTS 4,246,867 1/1981 Hudson ..... 118/658 X
4,285,297 8/1981 Suzuki ..... 118/657
4,331,757 5/1982 Tanaka et al. ..... 355/3 DD X
4,518,245 5/1985 Bares ..... 355/3 DD
4,597,661 7/1986 Yamashita .
4,615,606 10/1986 Nishikawa .

FOREIGN PATENT DOCUMENTS 173763 10/1983 Japan ..... 355/3 DD

*Primary Examiner*—A. T. Grimley
*Assistant Examiner*—Edward Pipala
*Attorney, Agent, or Firm*—Wenderoth, Lind & Ponack

[57] ABSTRACT

A developing apparatus includes a developing roller confronting an image support member for generating an electrostatic latent image on its surface, an accommodating tank for accommodating developing material therein, and a supply roller disposed to confront the developing roller so as to supply the developing material accommodated within the accommodating tank onto the developing roller, and is characterized in that a developing material supply width of the supply roller is smaller than the effective developing width of the developing sleeve.

8 Claims, 4 Drawing Sheets

DEVELOPING APPARATUS

BACKGROUND OF THE INVENTION

The present invention generally relates to electrophotography and more particularly, to a developing apparatus for use in an image forming apparatus such as an electrophotographic copying apparatus or the like.

Conventionally, as one example of a developing apparatus of the type referred to above, there has been proposed, for example, in U.S. Pat. No. 4,615,606, an arrangement as shown in FIG. 5 which includes a developing sleeve S disposed adjacent to an electrostatic latent image support member or a photoreceptor drum 1, a magnet roller M having a plurality of magnets with magnetic poles extending in an axial direction and defined adjacent one another in a circumferential direction, and incorporated within said developing sleeve S, a toner supply roller T formed on its surface with very small recesses (not shown) and confronting the peripheral surface of said developing sleeve S with a predetermined gap defined therebetween and a toner accommodating portion H located above or at a side portion of said toner supply roller T.

In the above-described developing apparatus, the developing material held on the surface of the developing sleeve S forms a magnetic brush along magnetic lines of force of the magnets provided on the magnet roller M so as to form a toner image on the surface 1a of the electrostatic latent image support member or photoreceptor drum 1 after rubbing against said surface.

Between the developing sleeve S and the supply roller T, there is impressed a potential difference, by which toner corresponding to the consumption thereof is replenished to the developing sleeve S.

In the above-described known developing apparatus, however, situations arise in which the toner falls from the very small recesses due to centrifugal force or vibrations, etc. based on the rotation of the toner supply roller T, and accumulate on the roller end portions between the developing sleeve S and the toner supply roller T.

Thus, problems are present in which, for example, during withdrawal of the developing sleeve S for maintenance work or the like, the toner accumulated as described above is disturbed or diffused in the direction of width of the developing sleeve S, consequently casing toner to scatter from the developing apparatus to soil neighboring appliances. Also, because the toner mixing ratio becomes extremely high at the opposite end portions of the developing sleeve S, if said sleeve S is mounted in a state in which the toner is disturbed, undesirable fogging, specks and the like are formed in the copied images, thus resulting in a deteriorated image quality.

Furthermore, when a toner supply width of the supply roller T is larger than an effective magnetic brush width on the developing sleeve S, because a blade P is held in contact with the toner supply roller T so as to restrict the amount of toner passing thereby, the toner disposed at the end portions of the supply roller T and not contacting the magnetic brush as described above tends to aggregate and solidify on the blade P due to the contact therewith over a long period of time. When such aggregated and solidifed toner is finally transferred onto the developing sleeve S, a gap between the developing sleeve S and a magnetic brush bristle height restricting plate (not shown) is clogged by such toner, thus preventing a smooth transport of the developing material.

SUMMARY OF THE INVENTION

Accordingly, an essential object of the present invention is to provide a developing apparatus for use in an image forming apparatus such as an electrophotographic copying apparatus or the like, in which all the toner held on the surface of a toner supply roller is adapted to be capable of contacting the magnetic brush formed on a developing sleeve so as to substantially eliminate disadvantages inherent in the conventional developing apparatuses of this type.

Another object of the present invention is to provide a developing apparatus of the above-described type which has a simple construction and operates accurately, and which can be readily manufactured at a low cost.

In accomplishing these and other objects, according to one preferred embodiment of the present invention, there is provided a developing apparatus which includes a developing roller confronting an image support member defining an electrostatic latent image on its surface, an accommodating tank for accommodating developing material therein, and a supply means confronting the developing roller so as to supply the developing material accommodated within the accommodating tank onto the developing roller, and is characterized in that a developing material supply width of the supply means is smaller than an effective developing width of the developing sleeve.

According to the present invention as described above, an improved developing apparatus is advantageously provided having a simple construction.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENT

Figure 1:
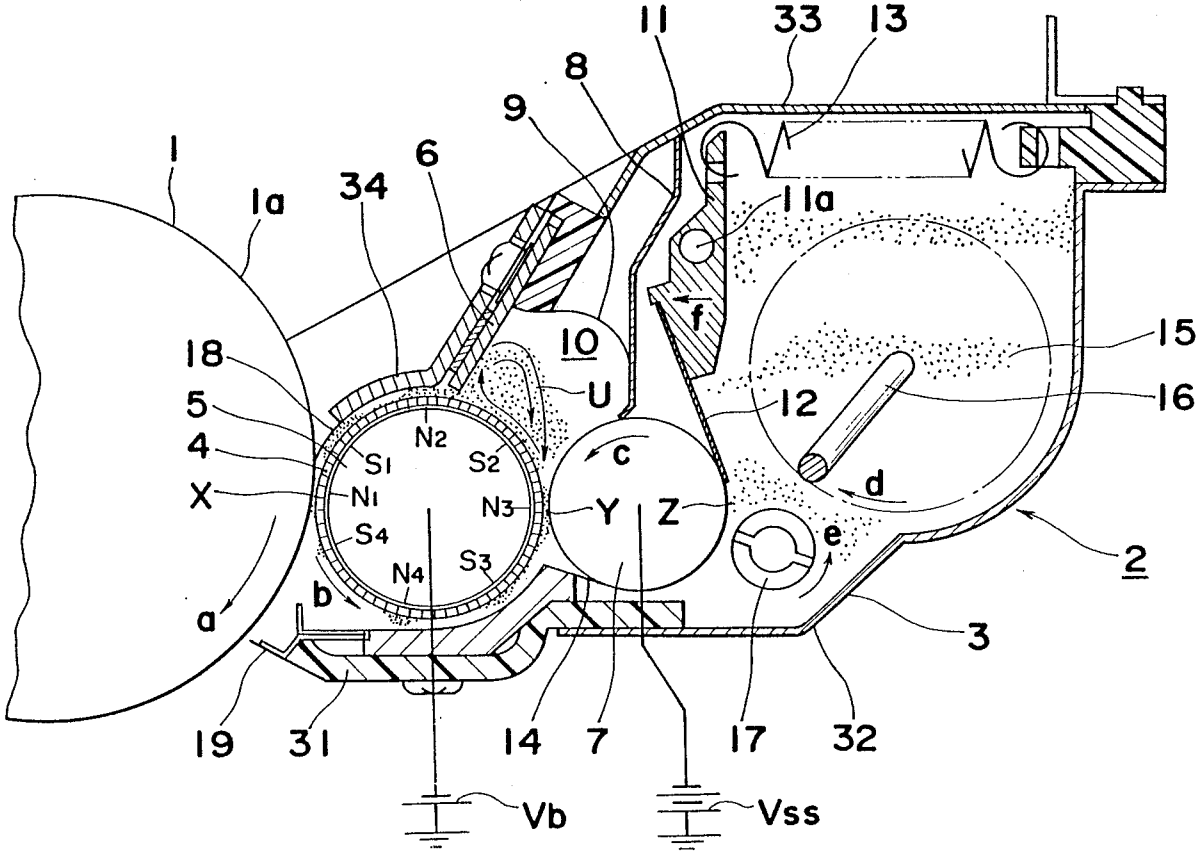
FIG. 1 is a schematic side sectional view of a developing section of an electrophotographic copying apparatus equipped with a developing apparatus according to one preferred embodiment of the present invention.

Before the description of the present invention proceeds, it is to be noted that like parts are designated by like reference numerals throughout the accompanying drawings.

Referring now to the drawings, there is shown in FIG. 1, a developing section of an electrophotographic copying apparatus provided with a developing apparatus 2 according to one preferred embodiment of the present invention, which is disposed at the side of an electrostatic latent image support member or photoreceptor drum 1 of the copying apparatus, and is arranged to supply toner to an electrostatic latent image formed on the photosensitive surface 1a of the photoreceptor drum 1 through charging and image exposure, so as to develop the electrostatic latent image into a visible toner image.

The developing apparatus 2 generally includes a developing tank 3 defined by walls 31, 32, 33 and 34 of a casing, a developing sleeve 4 and a toner supply roller 7 sequentially disposed toward the right of the photoreceptor drum 1 in FIG. 1, with a toner accommodating tank 15 being defined at the rear side of the toner supply roller 7.

In the developing apparatus 2 as described above, the developing sleeve 4 having a cylindrical shape and made an electrically conductive non-magnetic material, e.g., aluminum or the like, is impressed with a developing bias voltage Vb, and is adapted to be rotated in a counter-clockwise direction (i.e., in the direction indicated by an arrow b in FIG. 1) adjacent the surface 1a of the photoreceptor drum 1 rotating in the direction of an arrow a.

Meanwhile, a magnet roller 5 accommodated within the developing sleeve 4 includes a plurality of magnet members having axially extending magnetic poles $S_1$, $S_2$, $S_3$ and $S_4$, and $N_1$, $N_2$, $N_3$ and $N_4$ which are arranged in a circumferential direction so that the magnetic poles N and S are alternatively disposed at its outer peripheral portion, and is fixedly provided in a state as shown in FIG. 1, with the magnetic pole $N_1$ confronting the photoreceptor drum 1 and the magnetic pole $N_3$ at the opposite side of sleeve 4 facing the toner supply roller 7.

More specifically, two-component developing material composed of insulative toner and magnetic carrier and supplied onto the developing sleeve 4, is magnetically attracted onto the surface of the developing sleeve 4 by the magnetic force of the magnet roller 5 so as to form a magnetic brush along the magnetic lines of force generated by the magnetic poles, and is transported in a rotary direction (i.e., in the direction of the arrow b) of the developing sleeve 4 at the same speed as the rotating speed of said sleeve 4.

At the upper right portion above the developing sleeve 4, a brush bristle height restricting plate 6 fixed to the wall 34 confronts the surface of the developing sleeve 4 and a predetermined bristle height restricting gas is defined between the forward edge of wall 34 and the surface of the developing sleeve 4 so that part of the magnetic brush bristles formed on said sleeve 4 is knocked away by wall 34 thereby adjusting the amount of the developing material to be fed to the confronting portion between the photoreceptor drum 1 and the developing sleeve 4, i.e, the developing region X. Moreover, seal blades (not particularly shown) are held in contact with the peripheral surface adjacent to the opposite ends of the developing sleeve 4, thereby preventing the developing material from scattering.

The toner supply roller 7 formed of an electrically conductive non-magnetic material, e.g., aluminum or the like similar to the developing sleeve 4, is disposed parallel to and to the rear of said developing sleeve 4 in a position close thereto, has a collecting bias voltage Vss applied thereto, and rotates in the direction of arrow c.

Figure 2:
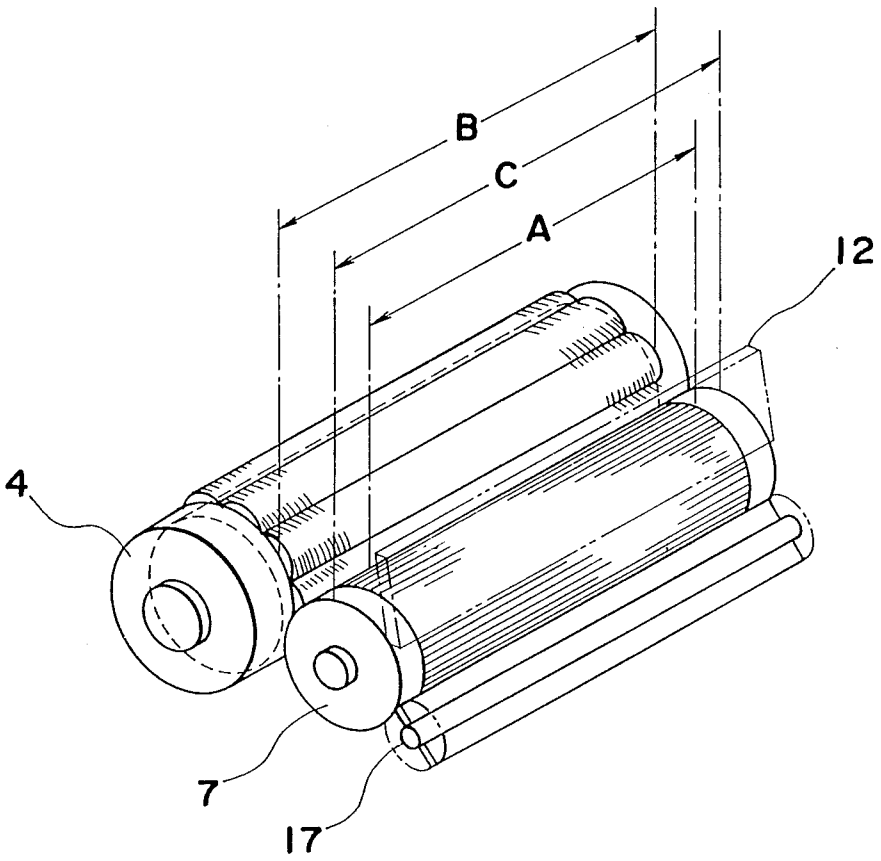
FIG. 2 is a perspective view showing the arrangement of a developing sleeve, a toner supply roller and a toner stirring vane employed in the developing apparatus of FIG. 1.
Figure 4:
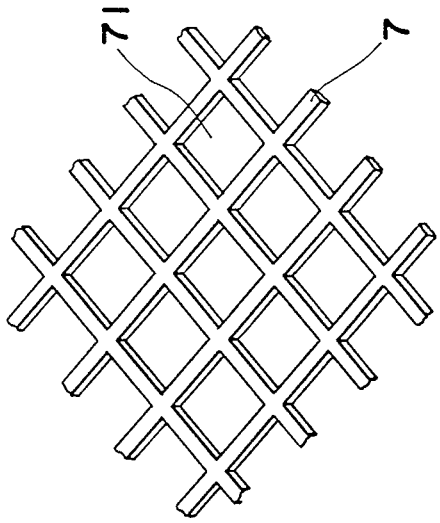
FIG. 4 is a fragmentary perspective view showing on an enlarged scale, the surface of the toner supply roller employed in the developing apparatus of FIG. 1.
Figure 3:
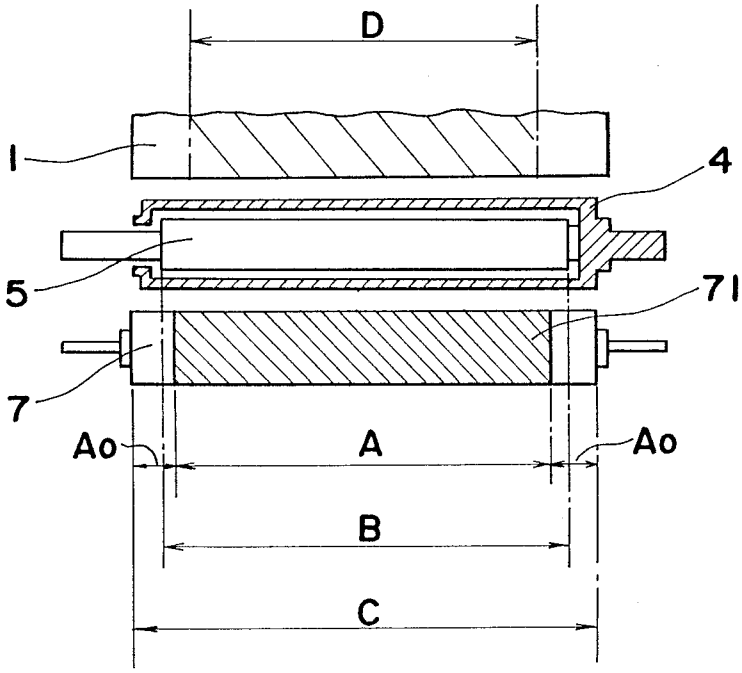
FIG. 3 shows cross sections of a photoreceptor drum partly broken away, the developing sleeve and the toner supply roller in the developing apparatus of FIG. 1.
Figure 5:
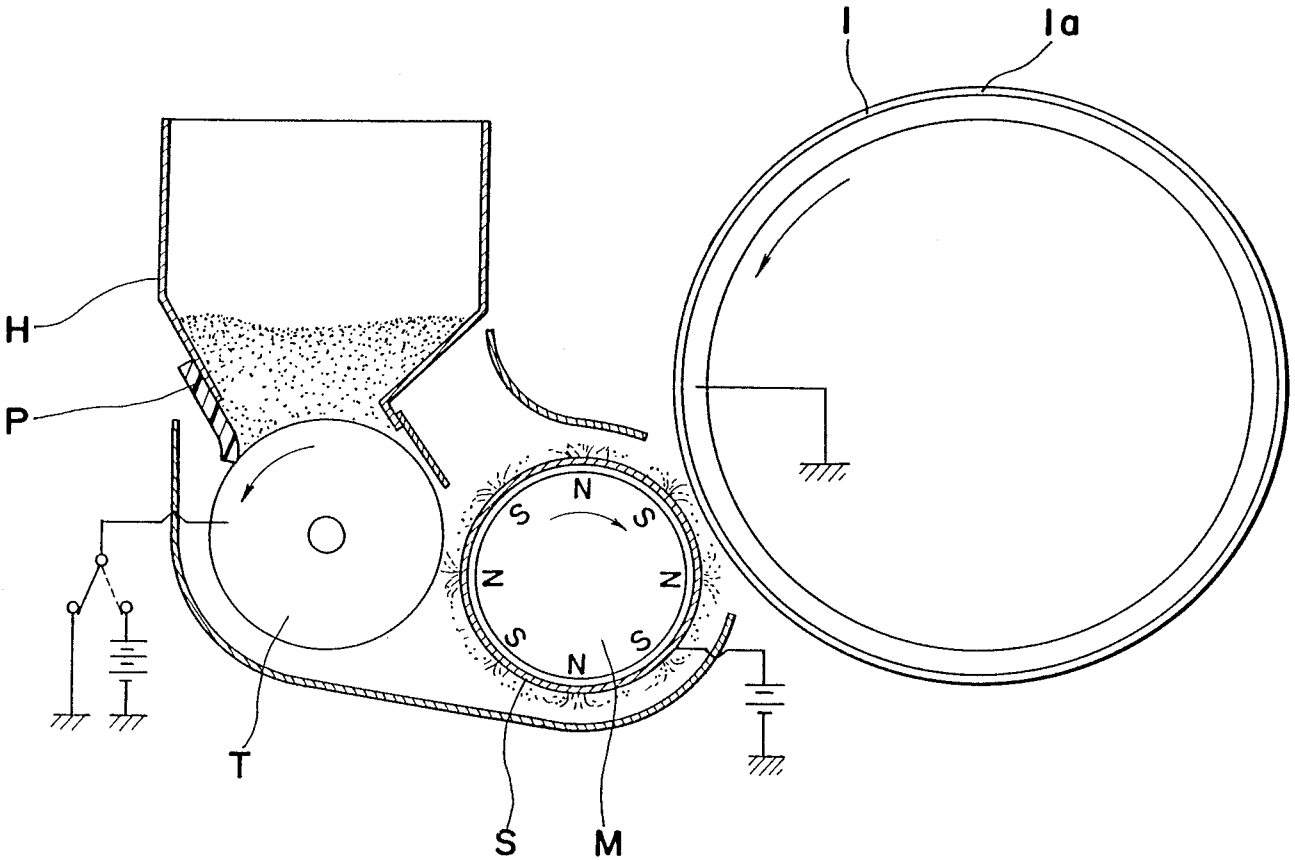
Fig. 5 PRIOR ART
FIG. 5 is a schematic side sectional view of a developing section of an electrophotographic copying apparatus equipped with a conventional developing apparatus (already referred to).

Furthermore, over the entire peripheral surface of the toner supply roller 7, there is formed a pattern including numerous very small recesses 71 having depths in the range of 5 to 60 μ, for example, as shown in FIG. 4, except for mirror-faced portions at the opposite ends of the roller 7 (i.e., the portions each having a width of Ao as illustrated in FIGS. 2 and 3).

It should be noted here that the pattern of the very small recess 71 is not limited to that shown in FIG. 4, but may be any other pattern formed by knurling, etching, blasting or the like so long as such a pattern serves the purpose of supplying toner.

The toner supply width A of the toner supply roller 7 formed with the pattern of very smaller recesses 71 as described above is smaller than the width of the magnet members of the magnet roller 5, and is also smaller than an effective magnetic brush width B over which the magnetic brush is formed by the magnet members extending upwardly in the radial direction. Meanwhile, said toner supply width A over which the very small recesses 71 are defined is larger than the image width D over which the electrostatic latent image is formed on the photosensitive surface 1a of the photoreceptor drum 1. Moreover, the entire width C of the toner supply roller 7 (toner collecting width) is larger than the effective magnetic brush width B.

In other words, the relation of the widths may be represented as $$D<A<B<C$$

where

A toner supply width
B effective magnetic brush width
C toner collecting width
D image width In a position above the toner supply roller 7, there is disposed a developing material receiving plate 8 attached to the upper wall 33 of the casing so as to confront the toner supply roller 7 in a non-contacting state, while a chamber 10 is defined above the confronting portions of the toner supply roller 7 and the developing sleeve 4, by the bristle height restricting plate 6, the developing material receiving plate 8 and a sheet 9.

Moreover, at the upper rear side of the toner supply roller 7, a partition wall 11 is pivotally connected to a frame for rotating about a shaft 11*a*, with the upper portion of said partition wall 11 being connected to one end of a compression spring 13 whose other end is connected to an upper rear end of the developing tank 3 so as to normally urge the partition wall 11 in the direction indicated by arrow f. Therefore, a toner restricting blade 12 made a ribbon plate 0.1 mm thick and attached to the lower portion of the partition wall 11 is held in contact with the surface of the toner supply roller 7 under a pressure of about 1.0 g/mm.

Additionally, under the toner supply roller 7, a toner returning prevention film 14 is attached to the lower wall 31 of the casing so as to contact the surface of the toner supply roller 7.

The toner accommodating tank 15 is formed by partitioning the rear portion of the developing tank 3 with the partition wall 11, toner restricting blade 12, toner supply roller 7 and toner returning prevention film 14, and within this toner accommodating tank 15, a stirring rod 16 and a stirring vane 17 located close to the roller 7 are rotatably provided so as to be respectively rotated in the directions indicated by arrows d and e.

Furthermore, at locations disposed above and below the confronting portions of the photoreceptor drum 1 and the developing sleeve 4, a dust prevention film 18 and a toner falling prevention plate 19 are respectively fixed to the upper and lower walls 34 and 31, thereby preventing the scattering and falling of toner in the developing tank 3.

Subsequently, the operation of the developing apparatus having the construction described above will be explained.

In the first place, a starter developing material composed of a mixture of magnetic carrier and insulative toner is placed in the chamber 10 located above the toner supply roller 7, while the insulative toner is also placed into the toner accommodating tank 15. However, instead of the starter developing material to be placed in said space chamber 10, only magnetic carrier may be used. Thus, it becomes possible to effect the development of an electrostatic latent image with the developing apparatus 2.

In the above-described state, when a print switch (not shown) is turned on, the developing sleeve 4, toner supply roller 7, stirring rod 16 and stirring vane 17 start rotating respectively in the directions indicated by arrows b, c, d and e.

Under the operation of the developing device 2 as described above, at the bottom of the toner accommodating tank 15, the toner is caused to flow toward the toner supply roller 7 by the stirring rod 16, and is advantageously ground into fine particles by the stirring vane 17. The toner thus crushed falls into the very small recesses 71 formed in the peripheral surface of the toner supply roller 7 at a toner replenishing region Z for being transported in the direction of the arrow c, with an excessive amount thereof being scraped off by the toner restricting blade 12, and is preliminarily electrically charged by the contact thereof with said blade 12 so as to be brought into the confronting portion with respect to the developing sleeve 4 (i.e., toner supply region Y).

In this case, although the toner is attracted onto the opposite end portions of the supply roller 7 through electrostatic attraction, etc., since each of such opposite end portions has a mirror face extending over the width Ao, all the toner thereat is scraped off by the blade 12 so as not to be supplied to the sleeve 4.

At the toner supply region Y, the developing material held on the developing sleeve 4 is transported in an upright state along the magnetic lines of force generated by the magnetic pole $N_3$ to form the magnetic brush. The toner on the toner supply roller 7 is scraped off by this magnetic brush and is supplied from the roller 7 onto the developing sleeve 4 due to the electrostatic attraction thereof toward the carrier on said sleeve 4.

Since the toner supply width A of the toner supply roller 7 is smaller than the effective magnetic brush width B of the developing sleeve 4, the toner on the toner supply roller 7 is positively transferred into the magnetic brush.

Simultaneously, based on a bias voltage difference (Vss−Vb) between the developing sleeve 4 and the toner supply roller 7, the toner on the developing sleeve 4 is electrostatically collected onto the toner supply roller 7 for maintaining the toner concentration in the developing material on the developing sleeve 4 constant.

Meanwhile, since the toner collecting width C is sufficiently larger than the effective magnetic brush width B, exta toner adhering to the opposite end portions of the developing sleeve 4 may be efficiently collected.

As described above, in the toner supply region Y, the supply and reception of toner are favorably effected between the developing sleeve 4 and the toner supply roller 7, and thus, the toner concentration is properly maintained on the developing sleeve 4.

The toner supplied onto the developing sleeve 4 is transported in the direction of arrow b together with the carrier held on the peripheral surface of said sleeve 4 during the rotation of said sleeve, and most of the developing material is blocked by the bristle height restricting plate 6 so as to travel along said plate 6, and thus be uniformly mixed and stirred while forming a vortex or a U-shaped path U, with the toner being triboelectrically charged through contact thereof with the carrier. Thus, part of the developing material sufficiently mixed and stirred passes through the gap between the bristle height restricting plate 6 and the developing sleeve 4 to form the magnetic brush, which rubs against the surface 1a of the photoreceptor drum 1 at the developing region X for developing the electrostatic latent image formed thereon into a visible image.

Since the effective magnetic brush width B on the developing sleeve 4 is larger than the image width D of the photoreceptor drum 1, the electrostatic latent image within the image width D can be positively developed.

More specifically, since the toner supply width A is larger than the image width D, the toner is positively present on the peripheral surface of the developing sleeve 4 corresponding to the image width D.

After passing through the developing region X, the developing material remaining on the peripheral surface of the developing sleeve 4 is successively transported in the direction of the arrow b under the rotation of the developing sleeve 4, and upon arrival at the toner supply region Y at which the developing sleeve 4 confronts the toner supply roller 7, is replenished with fresh toner thereat, while excessive toner is collected by the toner supply roller 7 in the manner as described earlier. Thus, upon reaching the chamber 10 again, the developing material sufficiently mixed and stirred while forming a vortex or U-shaped path U thereat is uniformly fed onto the surface of the sleeve 4, and the previous consuming pattern of the toner used in the last development is erased.

On the other hand, the toner collected onto the toner supply roller 7 enters the very small recesses 71 thereof, and passes through the space with respect to the toner returning prevention film 14 so as to be introduced into the toner accommodating tank 15.

It should be noted here that, in the foregoing, embodiment, although the toner supply width A, effective magnetic brush width B, toner collecting width C, and image width D are adapted to be set in the relation as $D<A<B<C$, the relation may be so modified to satisfy $D \leqq A \leqq B \leqq C$.

It should also be noted that, although the foregoing embodiment has been mainly described with reference to the developing apparatus employing two-component developing material composed of toner and carrier, the present invention is not limited in to such a developing apparatus, but may be readily applied to developing apparatuses having a mono-component developing material.

As is clear from the foregoing description, the present invention is drawn to a developing apparatus of the type arranged to form the magnetic brush by supplying the developing material onto the surface of the developing sleeve having the very small recesses defined on its surface, through the developing material supply roller so as to develop the electrostatic latent image by causing said magnetic brush to contact the peripheral surface of the electrostatic latent image support member, and is characterized in that the developing material supply width of the developing material supply roller is smaller than the effective magnetic brush width of the magnetic brush formed on the developing sleeve.

Accordingly, since all of the developing material to be supplied from the developing material supply roller to the developing sleeve is within the supply range to said developing sleeve, such developing material does not fall onto the opposite end portions of the developing sleeve or scatter therearound, nor is it collected and solidified through contact thereof with the blade. Therefore, even when the developing sleeve is detached or attached there is no possibility of the copied image being impaired, or of the surrounding appliances being soiled, whereby smooth transport of the developing material is facilitated.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as being included therein.

What is claimed is:

1. A developing device for developing a latent image formed on a latent image-bearing member over an image width thereof, said device comprising:

developing means comprising a developing sleeve confronting the latent image-bearing member, and a plurality of magnet members extending longitudinally within said developing sleeve over a predetermined distance for attracting a magnetic brush comprising toner onto the outer peripheral surface of said developing sleeve over an effective developing width thereof corresponding to said predetermined distance, said developing sleeve and said magnetic members mounted for relative rotational movement in said device for effecting transfer of the toner attracted over the effective developing width on the outer peripheral surface of said developing sleeve to the latent image-bearing member as said developing sleeve and said magnet members are moved relative one another; and a toner supply roller for supplying said developing means with toner, said toner supply roller comprising opposite end portions, and a central portion, at which toner is supplied to said developing means, disposed between said opposite end portions, the outer peripheral surface of only the central portion of said toner supply roller having a pattern of very small recesses defined therein by receiving toner, the width of the central portion of said toner supply roller being smaller than said effective developing width, and the entire width of said toner supply roller comprising said opposite end portions and said central portion being at least equal to said effective developing width.

2. A developing device as claimed in claim 1, wherein the depth of said very small recesses is within the range of 5 to 60 μm.

3. A developing device as claimed in claim 1, wherein the width of the central portion of said toner supply roller is larger than the image width over which the latent image is capable of being formed on the latent image-bearing member.

4. A developing device as claimed in claim 1, wherein the image width over which the latent image is capable of being formed on the latent image-bearing member is smaller than the width of the central portion of said toner roller, and the effective developing width is less than the entire width of said toner supply roller.

5. A developing device as claimed in claim 1, and further comprising voltage supply means for generating a voltage difference between said developing means and said toner supply roller to cause excess toner comprising the magnetic brush to be electrostatically attracted to said toner supply roller.

6. A developing device as claimed in claim 5, wherein the depth of said very small recesses is within the range of 5 to 60 μm.

7. A developing device as claimed in claim 5, wherein the width of the central portion of said roller member is larger than the image width over which the latent image is capable of being formed on the latent image-bearing member.

8. A developing device for developing a latent image formed on a latent image-bearing member over an image width thereof, said device comprising:

developing means comprising a developing sleeve confronting the latent image-bearing member, and a plurality of magnetic members extending longitudinally within said developing sleeve over a predetermined distance for attracting a magnetic brush comprising toner onto the outer peripheral surface of said developing sleeve over an effective developing width thereof corresponding to said predetermined distance, said developing sleeve and said magnetic members mounted for relative rotational movement in said device for effecting transfer of the toner attracted over the effective developing width on the outer peripheral surface of said developing sleeve to the latent image-bearing member as said developing sleeve and said magnet members are moved relative one another;

a toner hopper for accommodating a supply of toner;

a roller member disposed between said toner hopper and said developing sleeve for supplying said developing means with toner from said toner hopper, said roller member comprising opposite end portions, and a central portion, at which toner is supplied to said developing means, disposed between said opposite end portions, the outer peripheral surface of the central portion of said roller member having a pattern of very small recesses defined therein, and the outer peripheral surface of each of the end portions of said roller member being smooth, the width of the central portion of said roller member being smaller than the effective developing width and the entire width of said roller member comprising said opposite end portions and said central portion being at least equal to said effective developing width;

a scraper member contacting said roller member along the outer peripheral surface thereof for scraping off toner on the smooth outer peripheral surface of said end portions thereof while toner received in said recesses is allowed to pass thereby; and a voltage supply means for generating a voltage difference between said developing means and said roller member to cause excess toner supplied to said developing sleeve to be electrostatically attracted to said roller member.

* * * * *